US008562106B2

(12) United States Patent
Sakata et al.

(10) Patent No.: US 8,562,106 B2
(45) Date of Patent: Oct. 22, 2013

(54) INKJET PRINT HEAD AND INKJET PRINT APPARATUS

(75) Inventors: Yaado Sakata, Tokyo (JP); Masahiro Kobayashi, Hachioji (JP); Ryoichi Katano, Kawasaki (JP); Hiroyuki Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 273 days.

(21) Appl. No.: 13/049,345

(22) Filed: Mar. 16, 2011

(65) Prior Publication Data

US 2011/0249060 A1 Oct. 13, 2011

(30) Foreign Application Priority Data

Apr. 7, 2010 (JP) ..... 2010-088655

(51) Int. Cl.
*B41J 23/00* (2006.01)

(52) U.S. Cl.
USPC ..... 347/37

(58) Field of Classification Search
USPC ..... 347/37, 102
See application file for complete search history.

(56) References Cited

U.S. PATENT DOCUMENTS

| | | | | |
|---|---|---|---|---|
| 7,052,124 | B2 * | 5/2006 | Pickup | 347/102 |
| 7,946,700 | B2 * | 5/2011 | Rufes et al. | 347/102 |
| 8,070,275 | B2 * | 12/2011 | Silverbrook et al. | 347/86 |

FOREIGN PATENT DOCUMENTS

| | | |
|---|---|---|
| JP | 2004-025718 | 1/2004 |
| JP | 2004-042580 | 2/2004 |
| JP | 2004-306270 | 11/2004 |

* cited by examiner

*Primary Examiner* — Lamson Nguyen
(74) *Attorney, Agent, or Firm* — Fitzpatrick, Cella, Harper & Scinto

(57) ABSTRACT

There is provided an inkjet print apparatus which can prevent floating mists from being attached on a head face to realize a print with high quality. Therefore a wing-shaped print head is provided to increase an air flow flowing into a region between a print head positioned backward thereof and a print medium.

3 Claims, 18 Drawing Sheets

INKJET PRINT HEAD AND INKJET PRINT APPARATUS

BACKGROUND OF THE INVENTION

1. Field of the Invention

The present invention relates to an inkjet print apparatus, and particularly to an inkjet print head and an inkjet print apparatus which are provided with a plurality of print elements for scanning a print medium to spatter liquid droplets thereon.

2. Description of the Related Art

In recent years, in an inkjet print apparatus for performing a print by ejecting liquid droplets, the small-sized of the ejection liquid droplet is in progress. This is because, since a landing-on dot size formed at the time ejection liquid droplets land on a liquid droplet receiving member can be made small owing to the small-sized of the liquid droplet, a high-definition image can be formed to make an expression of a contour or an expression of a color tone enriched. However, even if the ejection liquid droplet is made small to improve a print concentration, it is important not to reduce the output time. Conventionally in a so-called multi-pass print of performing a plurality of times of scans on the same print location to complete a print, an image is formed by more print-pass numbers for producing a high-quality image, but an attempt of reducing the print-pass number has been recently made for realizing a print in high speeds.

In this way, the inkjet print technology is under the circumstance where targets of high image quality and high speeding are oriented to be simultaneously achieved. For realizing this high-speed print, for example, measures of performing a reciprocal print, increasing a carriage speed and the like are taken. However, in a case of increasing the carriage speed, since a region for the drawing per unit time is widened, it is necessary to increase the number of liquid droplets ejected from a nozzle per unit time, that is, it is necessary to make the ejection frequency be high.

On the other hand, this inkjet print has a phenomenon that extremely minute liquid droplets generated followed by ink ejection from nozzles float without reaching a liquid droplet receiving member. In regard to this phenomenon, due to a tendency of the increase in the ejection frequency in addition to the small-sized of the liquid droplet described above, an increase in the number of the aforementioned floating minute liquid droplets (hereinafter, called also floating mists) generated per unit time is remarkable. In addition, there are some cases where the minute liquid droplets are more likely to be generated depending on ink properties to be used so that the phenomenon that the liquid droplets become the floating mists remarkably occurs. The existence of these floating mists is one of problems in the product design.

An example of a problem caused by this floating mist is shown in the following. In an inkjet print system, print heads are mounted on a carriage to scan a print medium and at the same time, ink droplets are successively ejected from an ejection opening provided in the print head to perform a print on the print medium.

FIG. 17A and FIG. 17B are diagrams each schematically showing a state where a conventional print head 7 ejects ink while moving in a direction shown by an arrow α. Under a print condition where a drive frequency per nozzle is high, such as in a case of a solid print, a flow 502 curling up in an ejection opening forming face (hereinafter, called also head face) direction of the print head 7 is, as shown in FIG. 17A, generated between the print head 7 and a print medium 1 in the middle of printing. It should be noted that in the following drawings, in a case of simultaneously expressing the print head 7 and the flowing place, the flowing state is expressed by a coordinate system fixed in the print head 7 for convenience.

The aforementioned floating mists 504 rise by the flow 502 to be attached on the head face. Then, in the vicinity of the ejection nozzle line, a wet portion 11 of the ink is formed by the attached floating mists 504 to raise a problem of deterioration in image quality due to a mixed color and an ejection defect. The problem of this ink wetting is a big barrier to realizing a small number of the passes with the high image quality being maintained. Since the attachment of the floating mist 504 on the head face is a phenomenon generated in the middle of printing, the event that the attachment of the floating mists 504 cannot be avoided even by suction and wiping performed at the time the print head 7 is returned to a home position is a big problem.

For overcoming these problems, for example, Japanese Patent Laid-open No. 2004-025718 discloses a mechanism of collecting floating mists inside the print apparatus by sucking and discharging air inside the print apparatus by a suction fan arranged at an end portion of the print apparatus. However, the effect of reducing the attachment of the floating mists on the head face can not be expected. Japanese Patent Laid-open No. 2004-306270 proposes a method in which suction openings are provided between the respective print heads, and the floating mists are sucked by a fan connected to this suction opening.

In the construction of Japanese Patent Laid-open No. 2004-306270, since it is necessary to install the fan, it leads to generation of noises, an increase in size of the apparatus and an increase in costs. Further, since suction of air is forcibly performed in the vicinity of the ejection opening, there is a possibility that not only a track of the floating mists but also a track of ink droplets forming an image by landing on a print medium are shifted. In the construction of Japanese Patent Laid-open No. 2004-042580, an air resistance reducing unit is provided in a carriage bottom or in a print head side portion to restrict turbulence of the air, thus performing a reduction in a generation amount of mists to be generated in the print head. However, even if the generation amount of the mists is restricted, the attachment of the floating mists having been generated is not restricted.

The reduction in an amount of floating mists to be attached on the head face is thus still a difficult technology and a problem to be solved.

FIG. 18 is diagram showing the conventional print heads and shows the construction where a plurality of print heads are provided. There are some cases where the problem of the head face attachment of the floating mists clearly occurs in an inkjet print apparatus constructed of the print heads as shown in FIG. 18. It should be noted that in the following specification, an x axis is defined as a scan direction of the print head, a z axis is defined as a direction vertical to the print medium, and a y axis is defined as a direction at right angles to an x-y plane.

In a case of n pieces of print heads as shown in FIG. 18, a flow 406 curling up followed by ink ejection of a first print head 181 is weak and an attachment amount of mists on a head face is small. On the other hand, since flows 407 and 408 curling up are stronger in a second print head 182 to an $n^{th}$ print head 183 after the first print head 181 than in the first print head 181, more floating mists are resultantly attached on the head face. There is a tendency that a phenomenon that this attachment amount increases becomes furthermore marked in each print head in the order from forward to backward print heads in the scan direction. Therefore, the event itself that the floating mists are attached on the head face is a problem, but in a case where the plural print heads are provided, the event that the attachment amount of the floating mists on the head face differs in each print head also causes a difficulty in designing.

As described above, in the inkjet print apparatus with the plural print-head construction, there occurs the problem that the floating mists are more likely to be attached on the head face in each of the print heads subsequent to the print head positioned in the head in the scan direction to cause deterioration in print quality thereof.

SUMMARY OF THE INVENTION

Therefore the present invention has an object of providing an inkjet print head and an inkjet print apparatus which can prevent floating mists from being attached on a head face to realize a print with high quality.

In an inkjet print apparatus according to the present invention in which a plurality of print heads eject ink on a print medium from an ejection opening provided in the print head while moving in an arrangement direction of the print heads relatively to the print medium to perform a print thereon, the plurality of the print heads comprise a first print head positioned forward in the moving direction of the print head and a second print head adjacent to the first print head and positioned backward in the moving direction thereof, wherein the first print head is provided with a air flow guide face for guiding a air flow colliding with a front edge portion of the first print head in the moving direction into a region between the second print head and the print medium at the moving of the print head.

In addition, an inkjet print head according to the present invention comprises a plurality of print heads for ejecting ink on a print medium while moving in an arrangement direction of the print heads to perform a print thereon, wherein the print head is provided with a air flow guide face for guiding an air flow colliding with a front edge portion in the moving direction into a region between a print head positioned backward of the print head in the moving direction and the print medium at the printing.

According to the present invention, the plurality of the print heads in the inkjet print apparatus include the first print head positioned forward in the moving direction of the print head and the second print head adjacent to the first print head and positioned backward in the moving direction thereof. In addition, a portion of the first print head not facing the print medium is provided with the air flow guide face for guiding the air flow colliding with the front edge portion of the first print head in the moving direction thereof into the region between the second print head and the print medium at the moving of the print head. This construction can realize the inkjet print apparatus which can prevent floating mists from being attached on the head face to realize a print with high quality.

Further features of the present invention will become apparent from the following description of exemplary embodiments (with reference to the attached drawings).

DESCRIPTION OF THE EMBODIMENTS

Figure 1A:
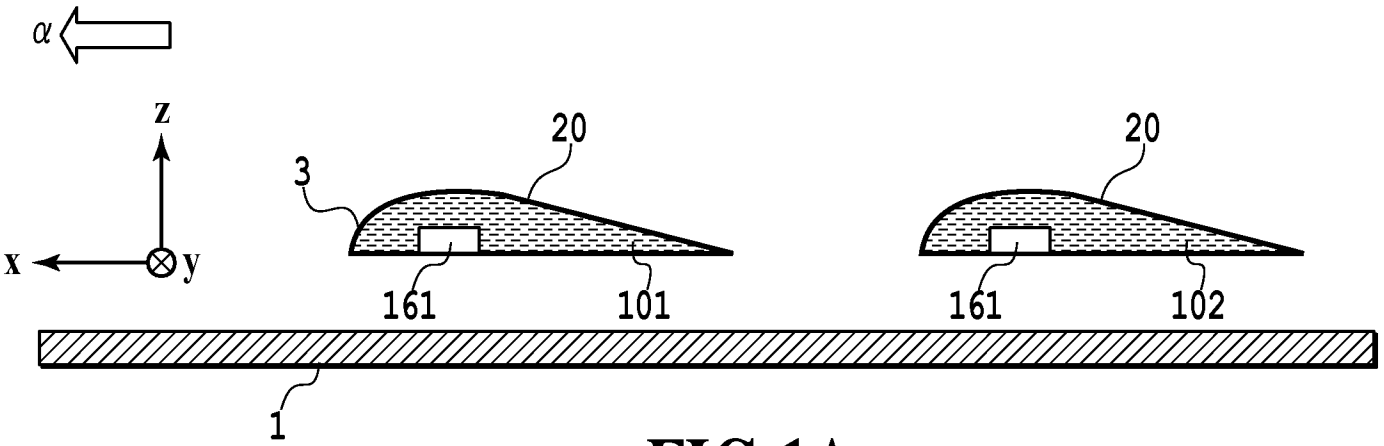
FIG. 1A is a diagram showing a print head construction of a first embodiment.

Hereinafter, embodiments of the present invention will be explained with reference to the accompanying drawings. The inventors have paid attention to existence of an air flow affecting a behavior of floating mists in addition to an air flow which is generated due to a flight of the floating mists and curls up on a head face. The air flow is one which flows into regions between a carriage and a print medium and between a print head and a print medium due to the movement of the carriage. As shown in 17B, studies of the inventors have confirmed that when the flowing-in air flow γ increases, the flow 504 curling up on the head face is restricted. It is also found out that when the flow 503 curling up on the head face is weakened, the number of floating mists following the curling-up flow 503 is also reduced to reduce the attachment of the floating mists 504 on the head face. It should be noted that a behavior 506 of the floating mists in the figure shows an example of the behaviors thereof, and the behavior does not necessarily become this track.

Therefore, for reducing the floating mist attachment on the head face, it is important to control a balance between the air flow γ flowing into a region between the print head 7 and the print medium 1 and the flow 503 curling up on the head face. The present invention applies the technical concept of increasing a flowing amount of this air flow to reduce the attachment amount of the floating mists to the inkjet print apparatus constructed of the plurality of the print heads.

Figure 18:
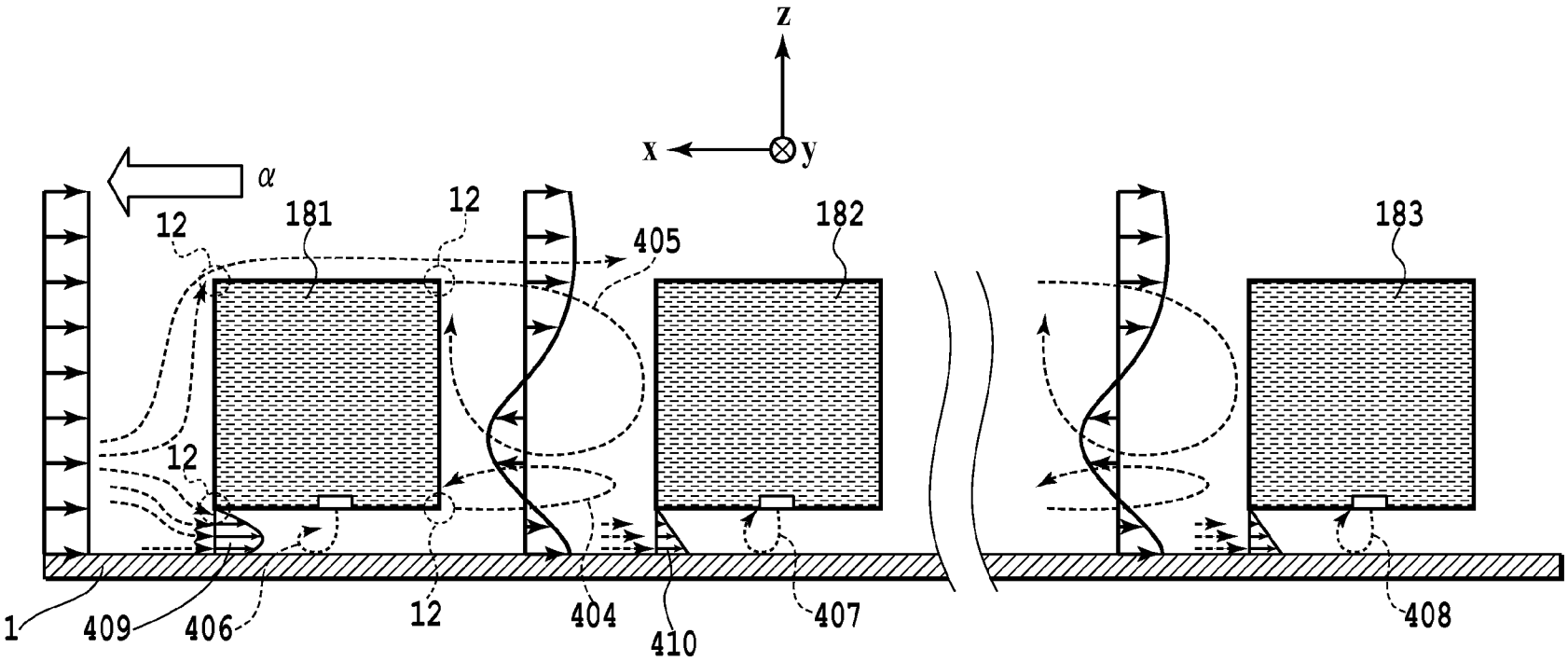
FIG. 18 is a diagram showing the conventional print heads.

Hereinafter, an explanation is made of an air flow around a print head in the conventional print head configuration and floating mists attached on a head face as a comparison example to the present invention. In many cases, the conventional print head configuration has corner portions 12 (refer to FIG. 18) an angle of each of which abruptly changes to a flow of a fluid. Therefore, a separation vortex (Karman vortex) 405 is generated after a first print head 181 to generate a reverse flow flowing in the same direction as the scan direction between print heads. In consequence, since an influence of the reverse flow strongly remains in the flow on a front face of a second print head 182, a flow amount of an air flow 404 colliding with the front face of the second print head 182 in the scan direction is reduced to be small.

At this time, an air flow amount flowing into a region between the first print head 181 and the print medium 1 and a air flow amount flowing into a region between the second print head 182 and the print medium 1 are compared. Since a strong flow 403 collides with the front face portion of the first print head 181, a flow 409 flowing in a large deal into the region between the first print head 181 and the print medium 1 is generated. However, since a flow amount colliding with the front face portion of the print head 182 is small as described above, a flow 410 an amount of which is relatively small as compared to the first print head 181 is generated in the second print head 182. Since the air flow flows in a large deal into the region between the first print head 181 and the print medium 1 as described above, an attachment amount of mists on the head face of the first print head 181 is small.

On the other hand, since a flowing amount of the air flow between the second print head 182 and the print medium 1 is relatively small as compared to that between the first print head 181 and the print medium 1, more floating mists are attached on the head face as compared to the first print head 181. The phenomenon that the air flow flowing into the region between the second print head 182 and the print medium 1 becomes small is generated in all the print heads from the second print head 182 to the $n^{th}$ print head 183 as the rearmost print head, and there is a tendency that the flowing-in air flow becomes remarkably smaller in the order from the forward print head to the backward print head. Therefore, the event itself that the floating mists are attached on the head face is a problem, but in a case where the plural print heads are provided, the event that the attachment amount of the floating mists on the head face differs in each print head also causes a difficulty in designing.

Here, since a distance between the separation vortex 405 and the second print head 182 is widened by widening a distance between the first print head 181 and the second print head 182 to reduce the influence of the reverse flow, an air flow amount flowing into the region between the second print head 182 and the print medium 1 can be increased. However, since the distance between the print heads each other is widened and a size of the print head construction is increased, it is necessary to enlarge the housing of the print apparatus, which is not desired in terms of costs. Therefore it is preferable to increase an amount of the flowing-in air flow without largely changing a positional relation between the print heads.

It should be noted that embodiments to be described hereinafter are appropriate, special examples of the present invention, and therefore various kinds of limitations which are preferable from technological points are added. However, so long as the concept of the present invention is satisfied, the present invention is not limited thereto.

A table 1 shows a table showing a scan speed of the print head and a distance between the print head and the print medium in the present embodiment.

TABLE 1

| | |
|---|---|
| Print head scan speed [m/s] | 1.0 |
| Distance between print head and print medium [m/s] | 1.2 |

Even drive conditions other than the condition in a table 1 can be treated as a target of the embodiment in the present invention so long as the restriction effect of the separation vortex itself matches the concept of the present invention.

First Embodiment

Figure 1B:
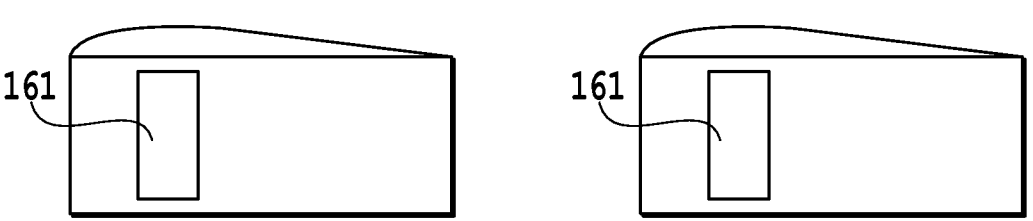
FIG. 1B is a diagram showing the print head construction of the first embodiment.

FIG. 1A and FIG. 1B are diagrams each showing the print head construction of the present embodiment. FIG. 1A is a diagram as viewed from a side face (y axis direction) and FIG. 1B is a perspective diagram. In the inkjet print apparatus of the present embodiment, two, wing-shaped, front and rear print heads 101 and 102 each provided with a chip 161 having a plurality of ejection openings as shown in FIG. 1A move in an arrangement direction (arrow α direction) of the print heads relatively to a print medium to perform a print thereon. In this construction, a wing front edge portion 3 of each of the wing-shaped inkjet print heads is provided in such a manner as to face in the scan direction.

Figure 2A:
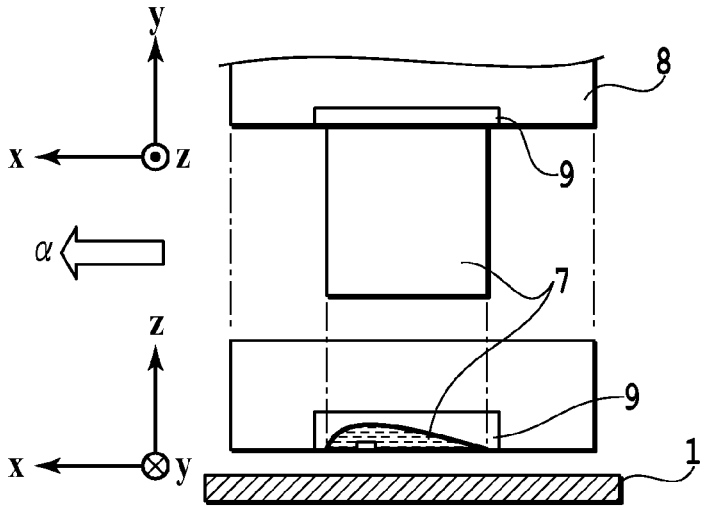
FIG. 2A is a diagram showing a print head fixed to a carriage.
Figure 2B:
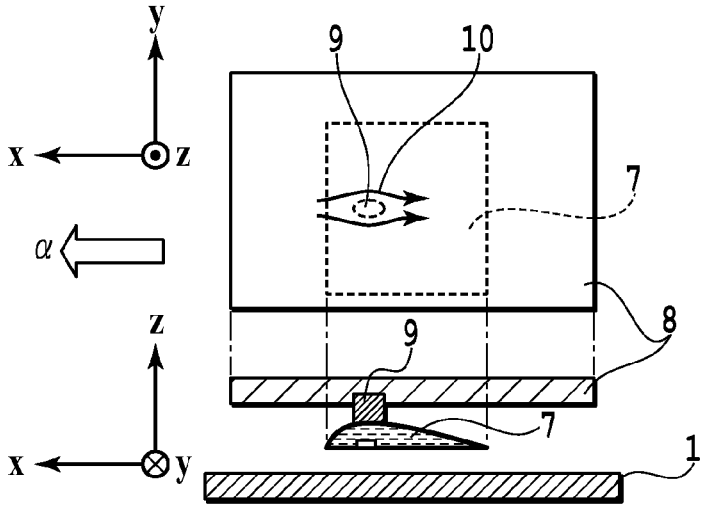
FIG. 2B is a diagram showing a print head fixed to a carriage.
Figure 2C:
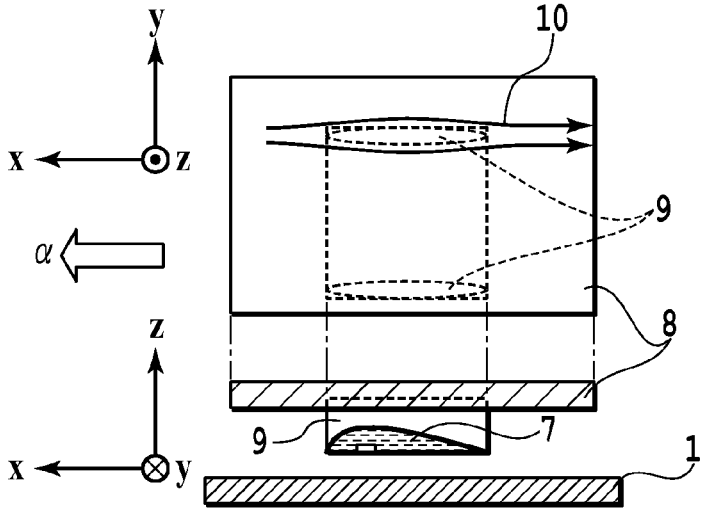
FIG. 2C is a diagram showing a print head fixed to a carriage.

FIG. 2A to FIG. 2C are diagrams each showing a state where a print head 7 is fixed to a carriage 8 in the present embodiment. FIG. 3A to FIG. 3E are diagrams each explaining an ink supply system of the inkjet print apparatus in the present embodiment. FIG. 4 is a diagram showing a state of an air flow flowing into a region between each print head and the print medium 1.

Since the first print head 101 is formed in a wing shape in the present embodiment, separation of the flow is difficult to be generated at the rear portion of the first print head 101 at scanning and the reverse flow is difficult to be generated in the flow 205 between the first print head 101 and the second print head 102. In addition, the first print head 101 is provided with an air flow guide face 20 and at moving, the air flow guide face 20 in the first print head 101 guides the air flow to a front face of the second print head 102. A part of the air flow guided to the front face of the second print head 102 flows into a region between the second print head 102 and the print medium 1.

In consequence, the more air flows 204 collide with the front face of the second print head 102 as compared to the construction of the conventional print head. As the flow amount of the air flow colliding with the front face of the second print head 102 is increased, the flow amount of the air flow flowing into the region between the second print head 102 and the print medium 1 is also increased. Therefore in the second print head 102, it is possible to weaken the curling-up flow generated by ink ejection. As a result, since the curling-up of the floating mists is reduced, it is possible to restrict the floating mist attachment amount on the head face in the second print head 102.

Figure 5:
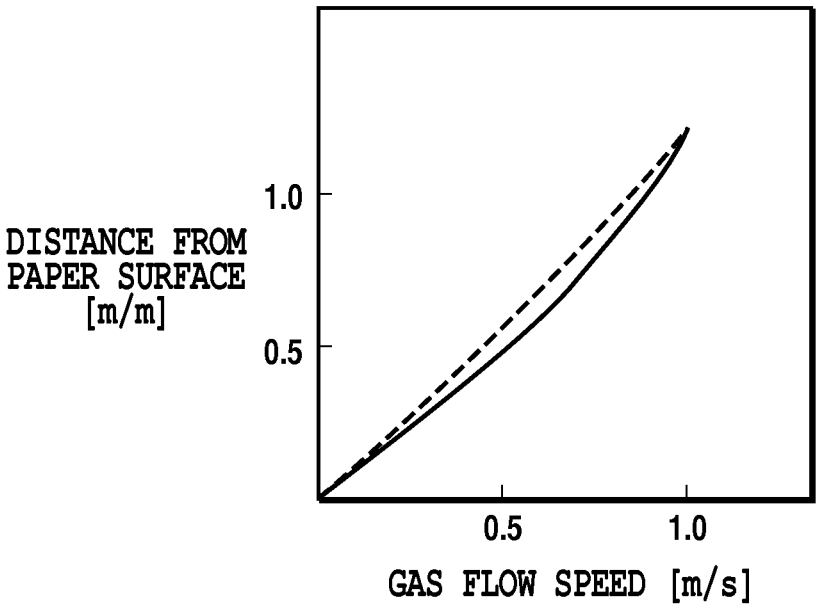
FIG. 5 is a graph showing a speed distribution of the air flow in a scan direction between a wing front edge portion of the print head and the print medium.

FIG. 5 is a diagram showing a speed distribution of an air flow in the scan direction between the wing front edge portion 3 of the second print head 102 and the print medium 1 at the time of performing a scan with the print head in the present construction. FIG. 5 expresses a speed of the air flow in a coordinate system fixed in the print medium. A dotted line shows a speed distribution of an air flow in the conventional print head and a solid line shows a speed distribution of an air flow in the print head of the present embodiment. As apparent from this graph, the flowing amount of the air flow between the second print head 102 and the print medium 1 in the print head of the present embodiment is increased as compared to the conventional one. This increase of the air flow enables a reduction in the attachment amount of the floating mists on the head face.

The graph shown in FIG. 5 shows a speed distribution of the air flow at the front end position of the print head in the scan direction, and a flowing speed of the air flow is gradually reduced toward the rear end side in the scan direction. As apparent from a positional relation between the head face, the chip and the nozzle line in the print head shown in the perspective diagram in FIG. 1A, it is preferable that the nozzle line position is provided at a position as close to the front end portion of the print head in the scan direction as possible.

Incidentally the print head 7 is fixed to the carriage 8 as shown in FIG. 2A to FIG. 2C. FIG. 2A shows a case of fixing the print head 7 to the carriage 8 at a connecting portion 9 positioned in a side face portion of the print head 7. In this case, the connecting portion 9 and the carriage 8 are provided on the side end portion of the wing and are not provided on the upper face thereof on which an air flow flows. Therefore, an impact thereof on the air flow on the wing upper face of the print head is small. FIG. 2B and FIG. 2C show a case of fixing the print head 7 and the carriage 8 at the connecting portion 9 positioned on the upper portion of the print head 7. In FIG. 2B, the print head 7 is fixed to the carriage 8 by one narrow connecting portion 9. In FIG. 2C, the connecting portion 9 is provided on each of the both side end portions in the upper portion of the print head 7 to fix the print head 7 to the carriage 8.

A cross section of the connecting portion 9 in any case in FIG. 2B and FIG. 2C is formed in a shape designed not to interrupt a flow of the air flow and in such a manner that a separation vortex or the like is difficult to be generated in the flow 10 in the periphery of the connecting portion 9. As shown in FIG. 2A to FIG. 2C, it is preferable in a case of applying the present invention to provide the configuration and the mounting position of the connecting portion 9 in such a manner that it is difficult to interrupt the separation restriction effect of the air flow by the wing-shaped print head. Therefore, a fixing method of the print head to the carriage may adopt any one so long as attention is paid on this respect.

Figure 3A:
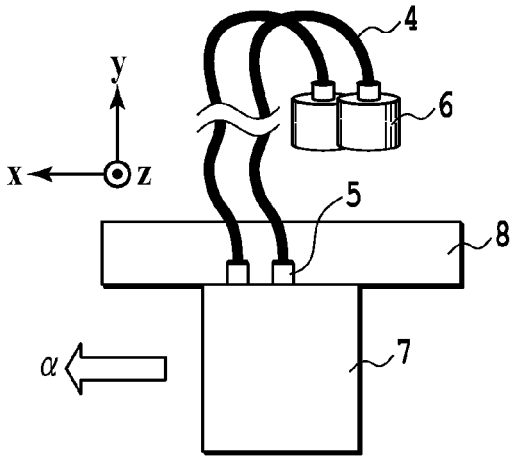
FIG. 3A is a diagram explaining an ink supply system of a print apparatus.
Figure 3D:
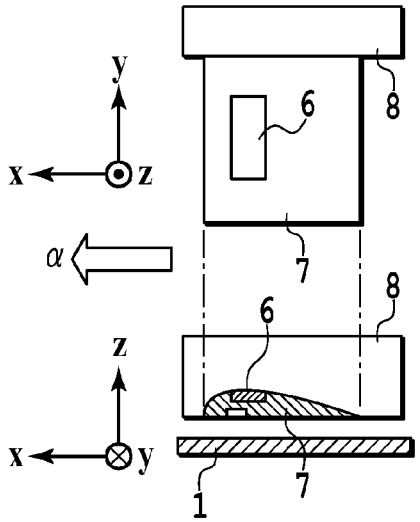
FIG. 3D is a diagram explaining an ink supply system of the print apparatus.
Figure 3B:
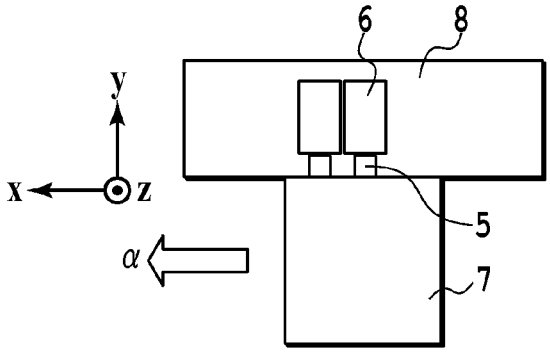
FIG. 3B is a diagram explaining an ink supply system of the print apparatus.
Figure 3E:
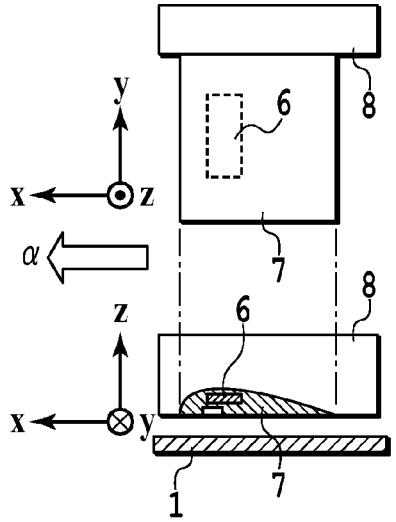
FIG. 3E is a diagram explaining an ink supply system of the print apparatus.
Figure 3C:
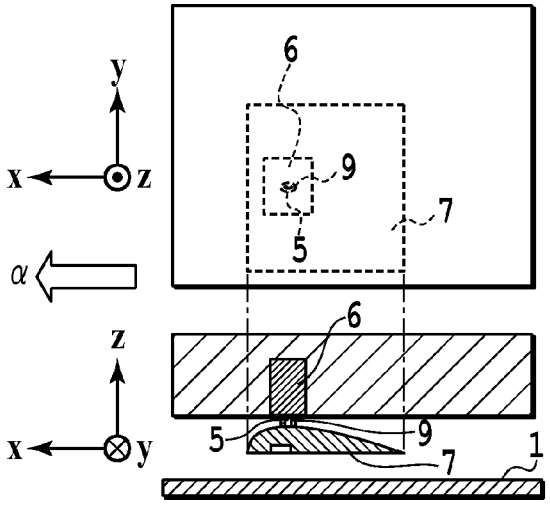
FIG. 3C is a diagram explaining an ink supply system of the print apparatus.
Figure 4:
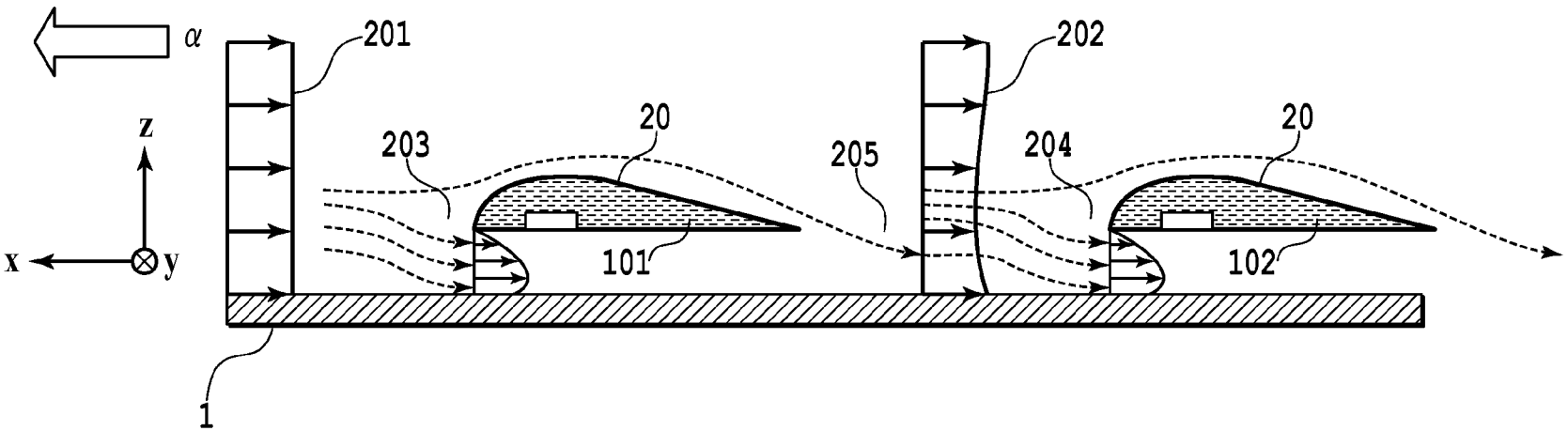
FIG. 4 is a diagram showing a state of an air flow flowing into a region between each print head and a print medium.

Further, in regard to supply of ink used in the print head 7, the construction that the ink is supplied from ink tanks 6 through ink supply tubes 4 and ink supply ports 5 is taken as an example as shown in FIG. 3A. On this occasion, for simplifying the structure, the ink tanks 6 may be connected directly to the print head 7 through the ink supply ports 5 positioned in the side portion of the print head 7 as shown in FIG. 3B. Further, as shown in FIG. 3C, the ink supply port 5 may be provided on the upper portion of the print head 7. As shown in FIG. 3D, the ink tank 6 may form a part of the wing configuration of the print head 7 or as shown in FIG. 3E the ink tank 6 may be stored inside the print head 7.

Any combination of the ink supply system construction shown in each of FIG. 3A to FIG. 3E and the positional relation between the carriage 8 and the print head 7 shown in each of FIG. 2A to FIG. 2C may be adopted if possible. As shown in each construction of FIG. 3A to FIG. 3E, it is preferable in a case of applying the present invention to provide the member in regard to the ink supply in such a manner that it is difficult to interrupt the separation restriction effect of the air flow by the wing-shaped print head. Therefore, an ink supplying method may adopt any one so long as attention is paid on this respect.

That is, a main point of the present invention is a phenomenon of "an increase function of an air flow flowing into a region between a print head and a print medium due to separation prevention of the flow on the print head upper portion using a wing-shaped head". Therefore, it is preferable in a case of applying the present invention to provide the configuration and the structure in the periphery of this print head in such a manner that it is difficult to interrupt the separation restriction effect of the air flow on the print head upper portion. Therefore, any configuration or construction may be adopted as the print head member so long as attention is paid on this respect.

By providing the wing-shaped print head in this way, the air flow flowing into the region between the backward print head and the print medium is increased. In consequence, there can be realized the inkjet print apparatus which can prevent floating mists from being attached on the head face to realize a print with high quality.

Second Embodiment

Hereinafter, a second embodiment of the present invention will be explained with the accompanying drawings. It should be noted that since a basic construction of the present embodiment is the same as that of the first embodiment, the featuring constructions only will be explained hereinafter.

Figure 6A:
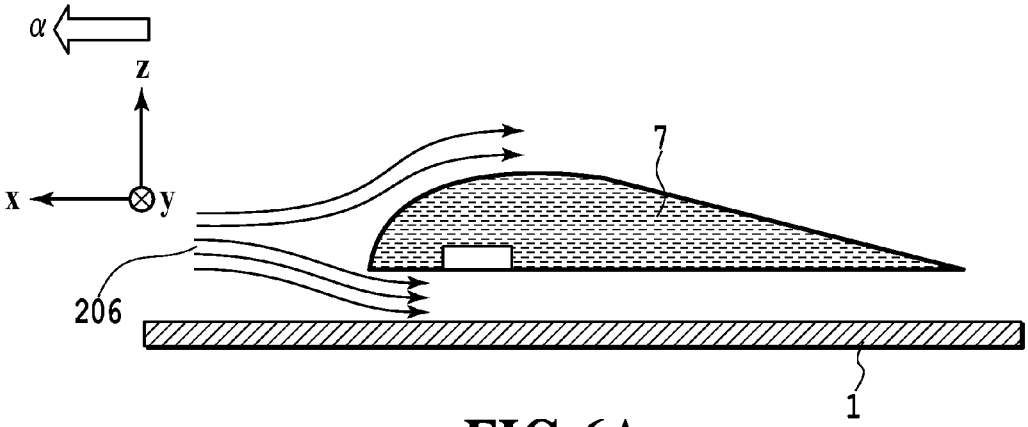
FIG. 6A is a diagram showing a print head in the print apparatus of the present invention.
Figure 6B:
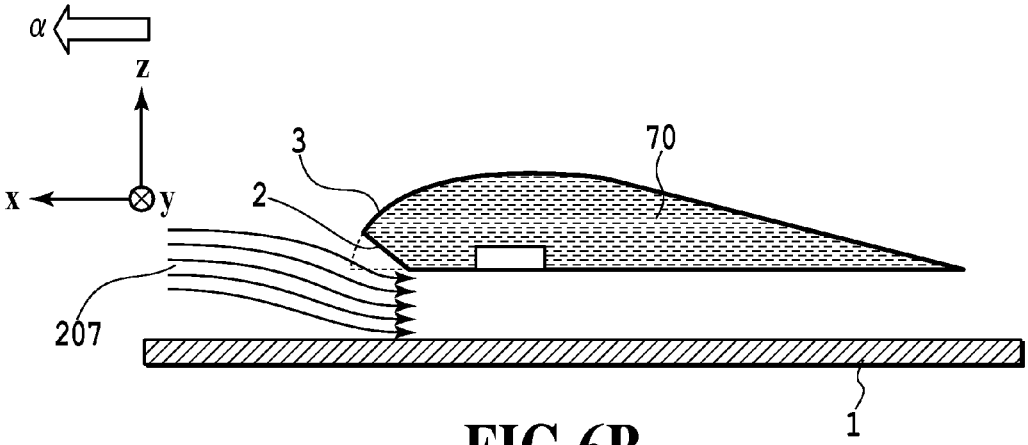
FIG. 6B is a diagram showing a print head in the print apparatus of the present invention.

FIG. 6A and FIG. 6B are diagrams showing print heads of the inkjet print apparatus in the present invention. FIG. 6A shows the print head of the first embodiment and FIG. 6B shows a print head of the present embodiment. Also in the present embodiment, the print head is a wing-shaped print head in the same way as in the first embodiment, but differs in a point that the wing front edge portion is provided with an air flow introduction guide face (hereinafter, called simply chamfered portion also) 2. Hereinafter, this chamfered portion 2 will be in detail explained. A print head 70 in the present embodiment is, as shown in FIG. 6B, provided with the chamfered portion 2 between the wing front edge portion 3 and the head face. This chamfered portion 2 serves as an introduction portion of the air flow flowing into a region between the print head 70 and the print medium 1, making it possible to suck more air flows into the region between the print head 70 and the print medium 1. In this way, this chamfered portion 2 enables more air flows to flow into a region between the print head to which a print head exists forward in the moving direction and the print medium 1 in a plurality of print heads arranged.

That is, as compared to a case where the chamfered portion 2 is not provided in the wing front edge portion 3 as shown in FIG. 6A, it is possible to increase an amount of the air flow flowing into the region between the print head 70 and the print medium 1. A print head positioned in the head of the moving direction is called a first print head, and a print head adjacent to the first print head and positioned backward in the moving direction is called a second print head.

Figure 7:
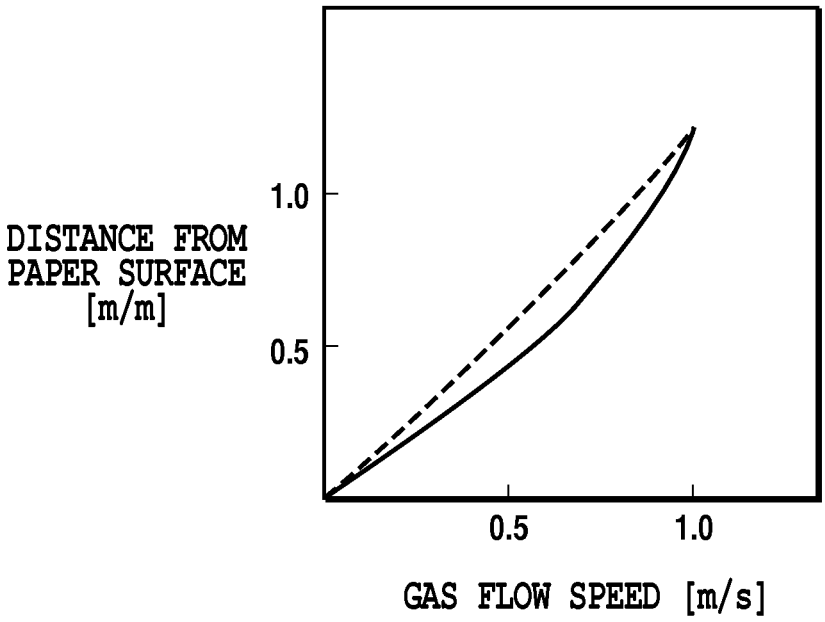
FIG. 7 is a graph showing a speed distribution of an air flow in a position of a print head front edge portion.

FIG. 7 is a graph showing an air flow speed distribution in the scan direction between a print head and a print medium in a position of the second print head front edge portion 3 in the present embodiment. It should be noted that FIG. 7 expresses a speed of the air flow in a coordinate system fixed on the print medium. Therefore, according to the present embodiment, in the second print head, more air flows flow in as compared to the conventional process, making it possible to reduce an attachment amount of the floating mists on the head face. It should be noted that in the present embodiment, the chamfered portions 2 are provided in both of the first print head and the second print head.

Figure 8A:
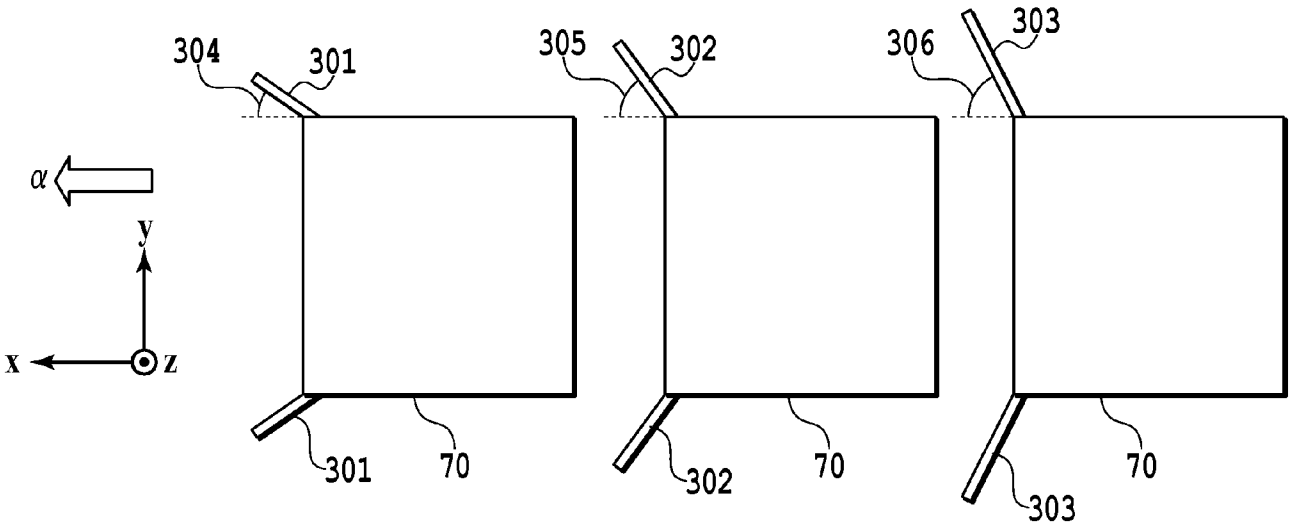
FIG. 8A is a diagram showing a modification of the print head in the present embodiment.
Figure 8B:
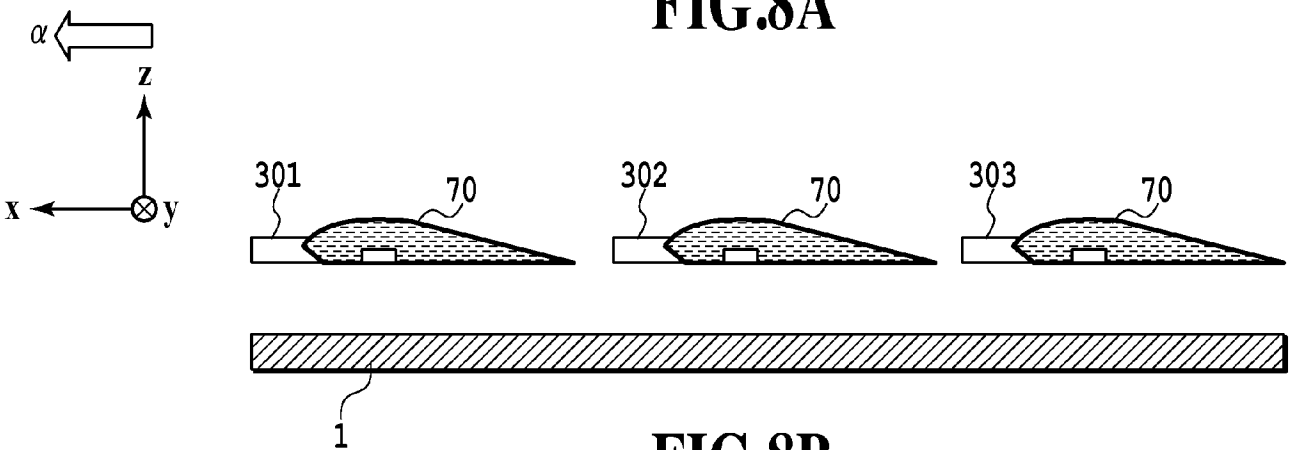
FIG. 8B is a diagram showing the modification of the print head in the present embodiment.

It should be noted that the configuration of the C chamfer is provided in the present embodiment, but a R chamfered configuration may be adopted. FIG. 8A and FIG. 8B are diagrams showing a modification of the print head in the present embodiment, wherein FIG. 8A shows a top view and FIG. 80 shows a side view. Each of air flow control plates 301 to 303 as shown in FIG. 8A and in FIG. 8B is mounted to a front portion of each print head, and mount angles 304 to 306 of the respective air flow control plates are made to be different. Thereby, a collision amount of the air flow with the print head may be more actively increased to promote a flow amount increase of the air flow flowing into the region between the print head 70 and the print medium 1. It should be noted that the mount angle of the air flow control plate is not required to be different in each print head. In addition, the print head configurations in which the C chamfer and the R chamfer exist to be mixed may be adopted.

In this way, by providing the wing-shaped print head with the air flow introduction guide face (chamfered portion) and providing the air flow control plate to this print head, the air flow flowing into the region between a print head positioned in the backward side thereof and the print medium is increased. With this construction, there can be realized the inkjet print apparatus which can prevent the floating mist from being attached on the head face to realize a print with high quality.

Third Embodiment

Hereinafter, a third embodiment of the present invention will be explained with the accompanying drawings. It should be noted that since a basic construction of the present embodiment is the same as in the first embodiment, hereinafter the featuring constructions only will be explained.

Figure 9A:
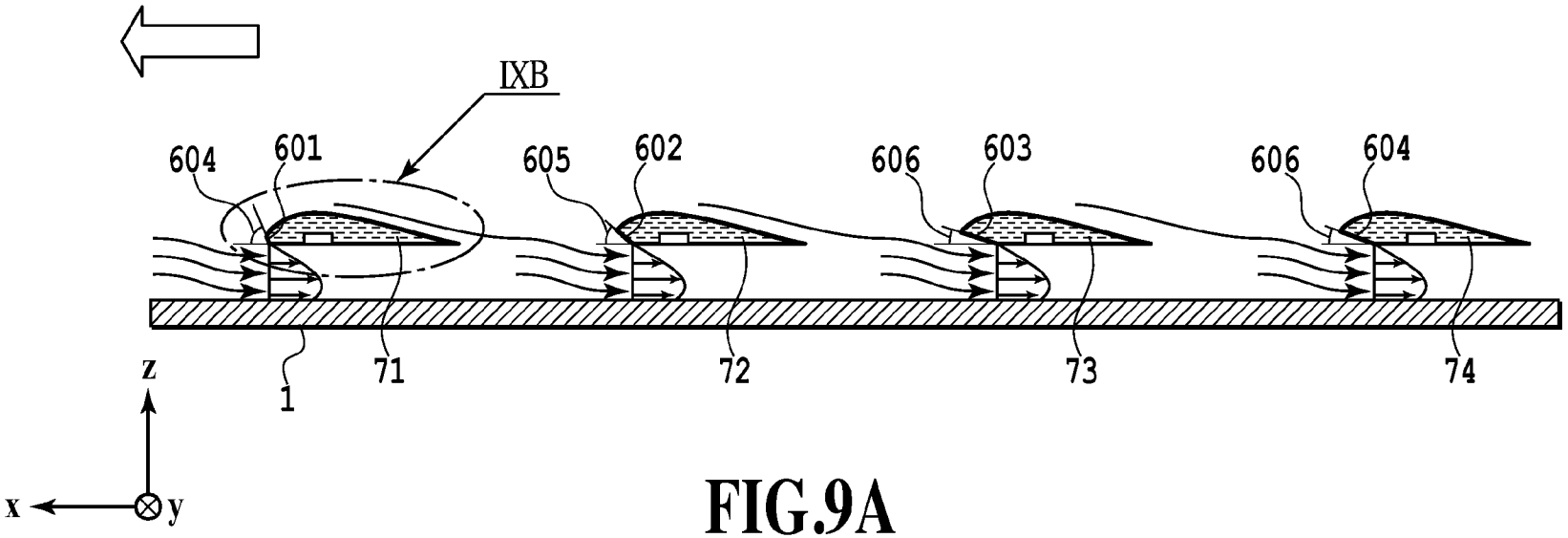
FIG. 9A is a diagram showing the construction of a print head in a third embodiment.
Figure 9B:
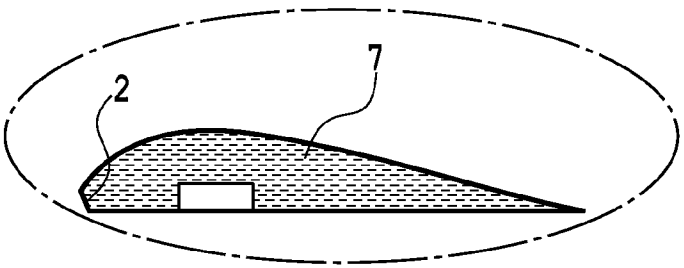
FIG. 9B is an enlarged diagram showing a part of the print head of FIG. 9A.

FIG. 9A is a diagram showing the construction of print heads in the present embodiment. The present embodiment is constructed in such a manner that four print heads are provided and each print head is provided with a different chamfered portion. That is, each of the chamfered portions has a smaller chamfered angle in the order from the forward to backward print heads.

Figure 10:
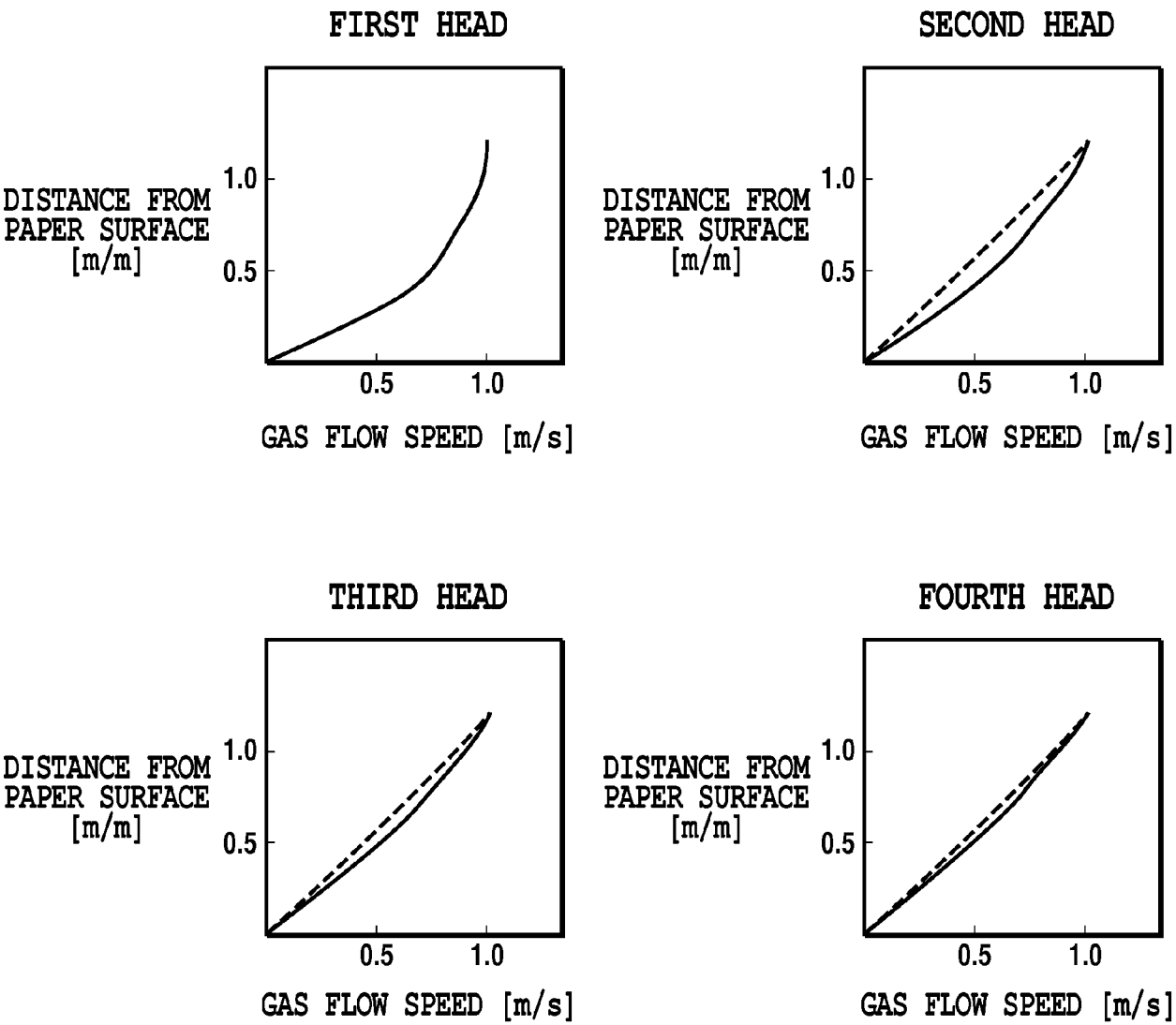
FIG. 10 is graphs each showing a speed distribution of an air flow in a front end position of each print head in a scan direction.

FIG. 10 is graphs each showing, in a case where the four print heads are provided as in the case of the present embodiment and the same chamfered portion is provided in each print head as in the second embodiment, a speed distribution of an air flow in a front end position of each print head in the scan direction. In FIG. 10, a speed of an air flow is expressed in a coordinate system fixed on the print medium. In a case of providing the same chamfered portion in each print head, a flowing amount of the air flow into the region between each print head 70 and the print medium 1 differs depending on an influence of the front and back print heads 70 thereof, and there is a tendency that an amount of the air flow flowing into the region between the print head and the print medium is reduced to be smaller in the order from the forward to the backward print heads in the scan direction.

The event that the amount of the air flow flowing into the region between the print head and the print medium is thus reduced to be smaller in the order from the forward to the backward print heads in the scan direction leads to an increase in an attachment amount of the floating mists on the head face in the backward print head. In addition, since the amount of the flowing-in air flow differs in each print head, the attachment amount of the floating mists on the head face differs in each print head, raising a problem of the difficulty in designing.

Therefore, in the present embodiment, a size of each chamfer 601 to 604 or each chamfered angle 605 to 608 of the chamfered portions 2 in the respective print heads 71 to 74 is changed to prevent the amount of the air flow flowing into the region between each print head and the print medium from differing. As the chamfered portion 2 is formed to be larger and shallower, the flowing amount of the air flow flowing into the region between the print head and the print medium 1 becomes the larger. Therefore, in the present embodiment, the chamfered portion 2 is formed to be larger and shallower in the order from the forward to backward print heads.

Figure 11:
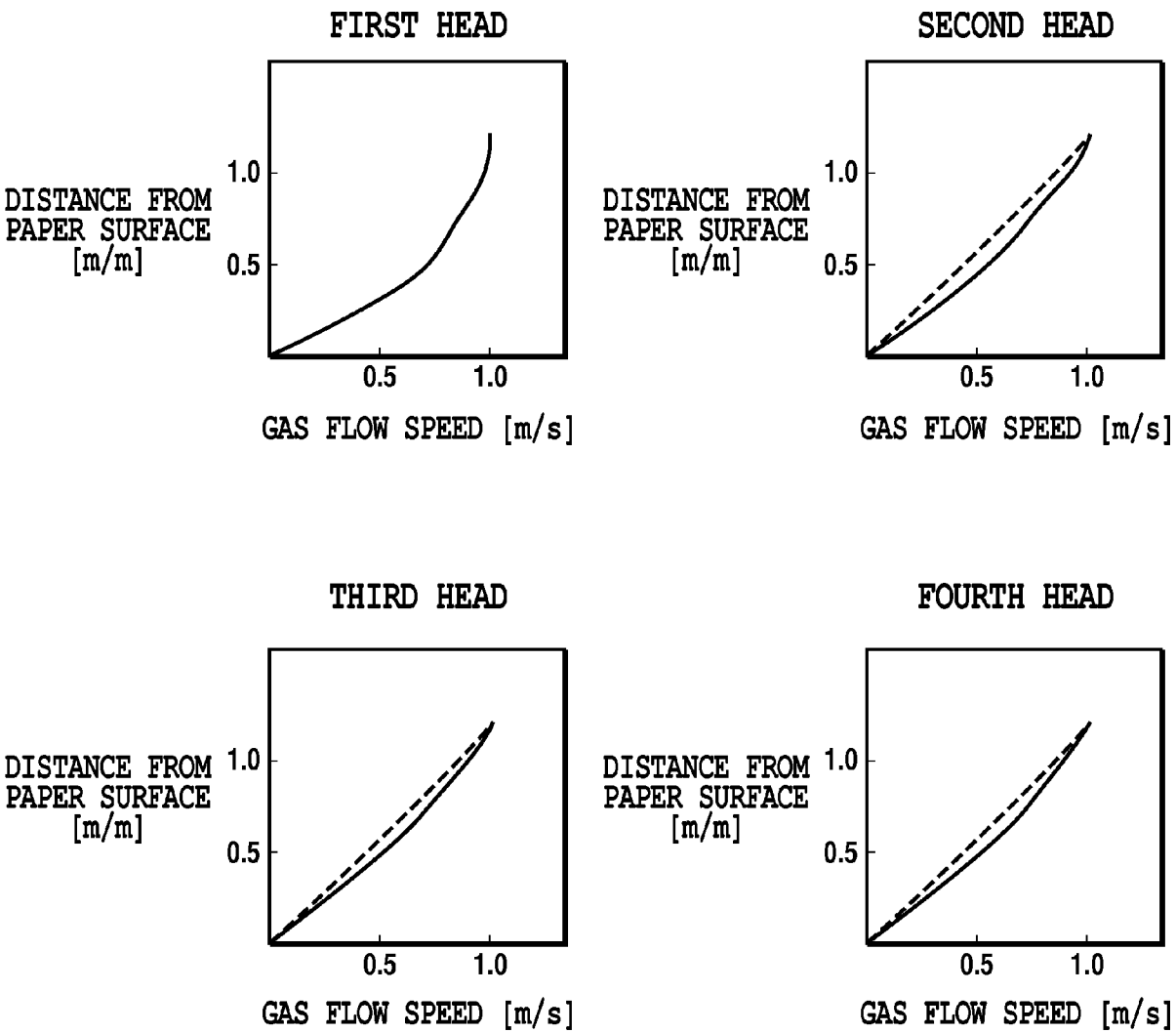
FIG. 11 is graphs each showing a speed distribution of a air flow between a front edge portion of the print head and the print medium.

FIG. 11 is graphs each showing an air flow speed distribution in the scan direction between the front edge portion 3 of each print heads 71 to 74 and the print medium 1. FIG. 11 expresses a speed of the air flow in a coordinate system fixed on the print medium. It is found out that an amount of the air flow flowing into a region between each of the print heads 71 to 74 and the print medium 1 is substantially equal from the second print head 72 to the fourth print head 74. Therefore, it can be expected that the attachment of the floating mists on the head face is reduced to be substantially equal between the heads.

It should be noted that in the present embodiment, a size and an angle of the C chamfered portion are adjusted for each print head, but the chamfered portion may be formed as a R chamfered portion a size and an angle of which are changed. Alternatively also by providing the air flow control plates 301 to 303 having different angles and different lengths as shown in FIG. 8A and FIG. 8B, a flowing amount of the air flow can be adjusted. At this time, the air flow control plate can increase the flowing amount the furthermore as it has a wider and shallower angle. In addition, the construction that the C chamfer, the R chamfer and the air flow control plate are mixed may be adopted.

By thus providing the wing-shaped print heads having different chamfered portions, the air flow flowing into a region between a print head in the backward side of the print head and the medium is increased. With this construction, there can be realized the inkjet print apparatus which can prevent the floating mist from being attached on the head face to realize a print with high quality.

Fourth Embodiment

Hereinafter, a fourth embodiment of the present invention will be explained with the accompanying drawings. It should be noted that since a basic construction of the present embodiment is the same as in the first embodiment, hereinafter the featuring constructions only will be explained.

Figure 12A:
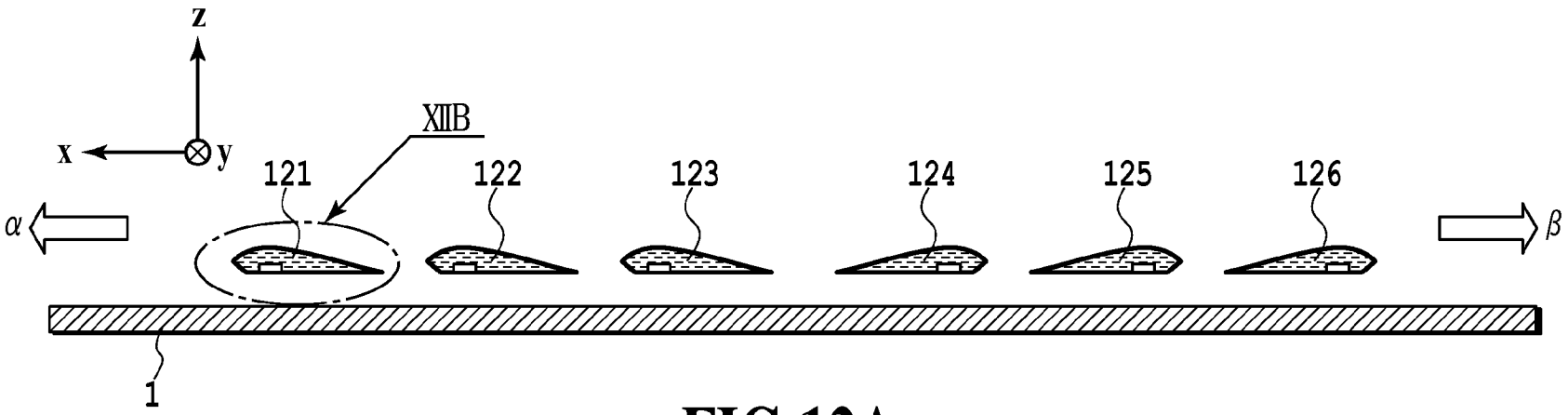
FIG. 12A is a diagram showing a print head construction in a fourth embodiment.
Figure 12B:
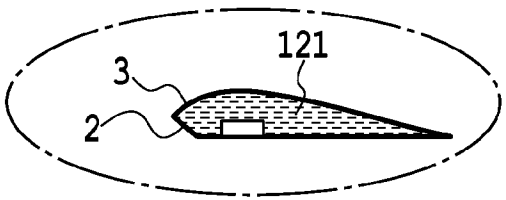
FIG. 12B is an enlarged diagram showing a part of the print head of FIG. 12A.

FIG. 12A is a diagram showing the construction of print heads in the present embodiment. The present embodiment is constructed in such a manner that the print head performs a reciprocal print drive and six print heads are provided. In the first to third embodiments, a print of a one-way scan is estimated to be performed, and in a case of performing a print by reciprocal movement, a collision direction of the air flow with each print head is reversed. However, the wing shape for restricting the separation of the air flow is designed by estimating the air flow going against the wing front edge portion. That is, separation of the air flow going in a direction reverse to a direction against the wing front edge portion can not be restricted.

Therefore, in a case of performing a reciprocal print with print head construction estimating the one-way print as performed in the first to third present embodiments, an equal reduction in an attachment of the floating mists on the head face in both prints in the reciprocal directions can not be expected.

Therefore, in the present embodiment, six print heads are provided and the print heads are divided into print heads used for the forward direction print and print heads used for the backward direction print to perform a print by dividing the print heads in the forward direction (α direction in an arrow) with the print heads in the backward direction (β direction in an arrow) for use. That is, at the time of the forward direction print, a first print head 121, a second print head 122 and a third print head 123 equipped with wing front edge portions 3 in the forward direction are used for a print.

At the time of the backward direction print, a fourth print head 124, a fifth print head 125 and a sixth print head 126 equipped with wing front edge portions 3 in the backward direction are used for a print. It should be noted that the print head in use only for a print in the forward path to eject ink may be any of the first print head 121 to the third print head 123. In addition, the print head in use only for a print in the backward path to eject ink may be any of the fourth print head 124 to the sixth print head 126.

Therefore, the print head for ejecting ink both in the forward path and in the backward path is constructed such that the air flow goes against the front edge portion 3 of the wing. In consequence, as compared to the conventional print head, the air flow flowing into the region between the print head and the print medium 1 can be increased to reduce the attachment amount of the floating mists on the head face both in the forward path and in the backward path.

It should be noted that in this construction, the number of the print heads used in the forward path only may be different from the number of the print heads used in the backward path only. That is, the present embodiment may be replaced by the following construction. First, for example, there is assumed a case where the print head number is n pieces, the number of the print heads used in the forward path only to eject ink is p pieces, the number of the print heads ink used in the backward path only to eject ink is q pieces, and a value of (n−p−q) is an even number. In addition, it is assumed that $n_{01}=(n-p-q)/2+p$, and $n_{n1}=(n-p-q)2+p+1$.

In this construction, the $n_{00}$ print head positioned in the head to the $n_{01}$ print head each equipped with the wing front edge portion 3 in a direction where the air flow at the forward path print collides are used for a print in the forward path direction. The $n_{n1}$ print head to the n print head positioned in the rearmost end each equipped with the wing front edge portion 3 in a portion with which the air flow at the backward path print collides are used for a print in the backward path direction. With this print head construction, the restriction effect of the separation vortex as the concept of the present invention can be obtained in each print head.

Figure 13A:
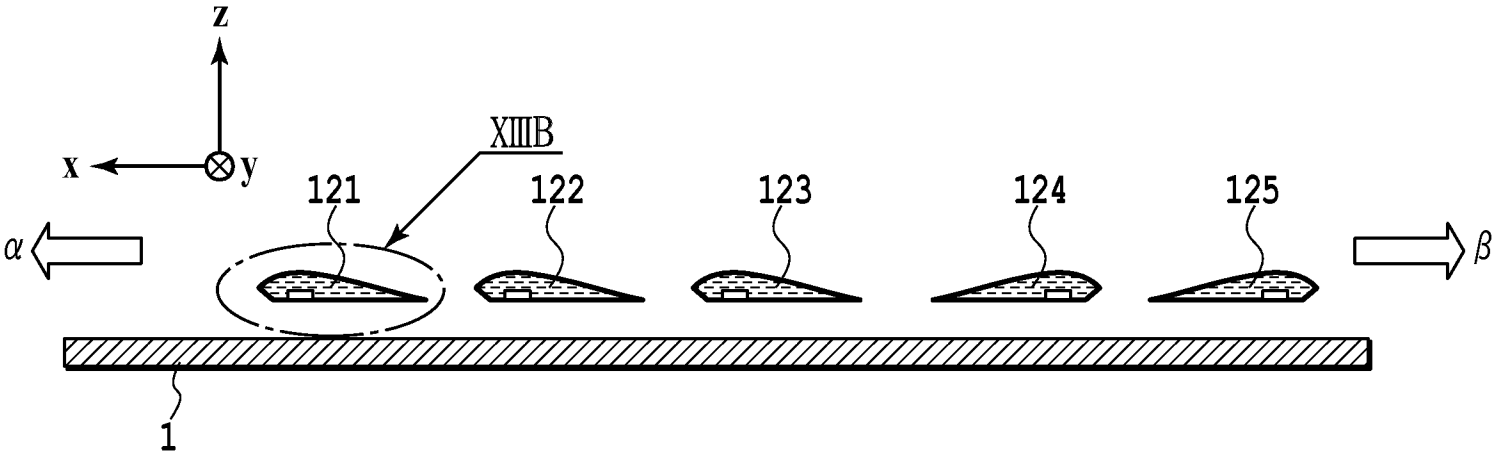
FIG. 13A is a diagram showing a print head construction of a modification in the fourth embodiment.
Figure 13B:
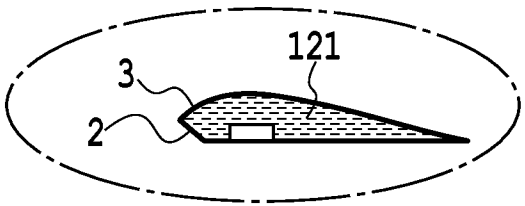
FIG. 13B is an enlarged diagram showing a part of the print head of FIG. 13A.

FIG. 13A is a diagram showing a print head construction of a modification in the present embodiment, which is a case where the number of the print heads is five pieces, wherein the number of the print heads used for a print in the forward path only is three pieces and the number of the print heads used for a print in the backward path only is two pieces. Even in this case, the first print head 121 to the third print head 123 are used for the forward path print and the fourth print head 124 and the fifth print head 125 are used for the backward path print. In consequence, an amount of the air flow flowing into a region between each of print heads for performing a print after the head print head in each scan direction and the print medium 1 can be increased to reduce an attachment amount of the floating mists on the head face.

By thus providing the wing-shaped print heads configured for both the directions of the forward direction and the backward direction, the air flow flowing into a region between a print head in the backward side of the print head and the print medium is increased. With this construction, there can be realized the inkjet print apparatus which can prevent the floating mist from being attached on the head face to realize a print with high quality.

Fifth Embodiment

Hereinafter, a fifth embodiment of the present invention will be explained with the accompanying drawings. It should be noted that since a basic construction of the present embodiment is the same as in the first embodiment, hereinafter the featuring constructions only will be explained.

Figure 14A:
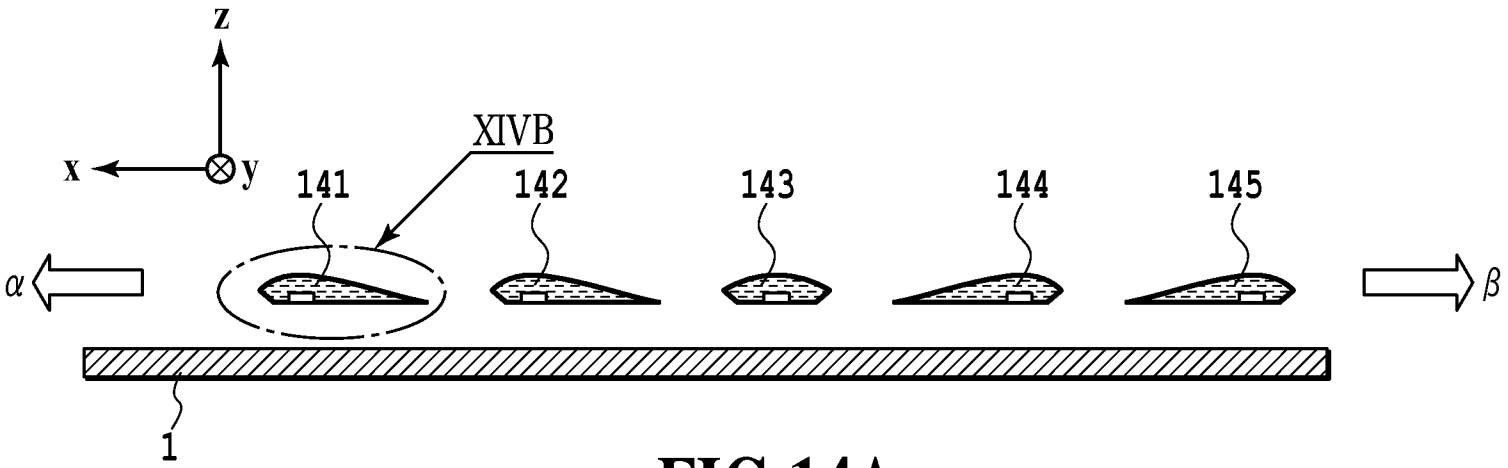
FIG. 14A is a diagram showing a print head construction in a fifth embodiment.
Figure 14B:
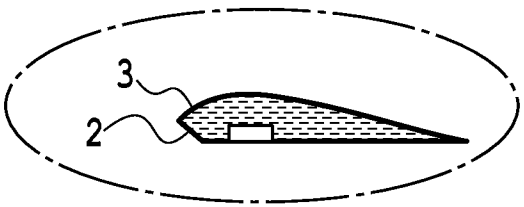
FIG. 14B is an enlarged diagram showing a part of the print head of FIG. 14A.

FIG. 14A is a diagram showing the construction of print heads in the present embodiment. The present embodiment is constructed in such a manner that the print head performs a reciprocal print drive and five print heads are provided. One of the five print heads is used for both the prints (interactive directions) in the forward direction print and the backward direction print. In the print head used for the print in the interactive directions, it is necessary to reduce an attachment amount of the floating mists on the head face in the prints in both the forward path and the backward path.

Therefore, in the print head construction in the present embodiment, a third print head 143 equipped with the wing front edge portions 3 at both of the forward direction and the backward direction is provided and this third print head 143 is used for the interactive print. As the other print heads, a first print head 141 and a second print head 142 each having the wing front edge portion 3 in the forward direction, and a fourth print head 144 and a fifth print head 145 each having the wing front edge portion 3 in the backward direction are configured of the same construction as in the aforementioned embodiment.

With this construction, the print head (third print head) 143 for ejecting ink both in the forward path and in the backward path is constructed such that the air flow goes against each of the front edge portions 3 of the wing. In consequence, as compared to the conventional print head, the air flow flowing into the region between the print head and the print medium 1 can be increased to reduce the attachment amount of the floating mists on the head face both in the forward path and in the backward path.

Further, if the print heads after the third print head 143 in the forward path and in the backward path (the fourth print head 144 and the fifth print head 145 in the forward path direction print and the first print head 141 and the second print head 142 in the backward path direction print) do not perform ejection in this construction, the flowing construction may be permitted.

Figure 15A:
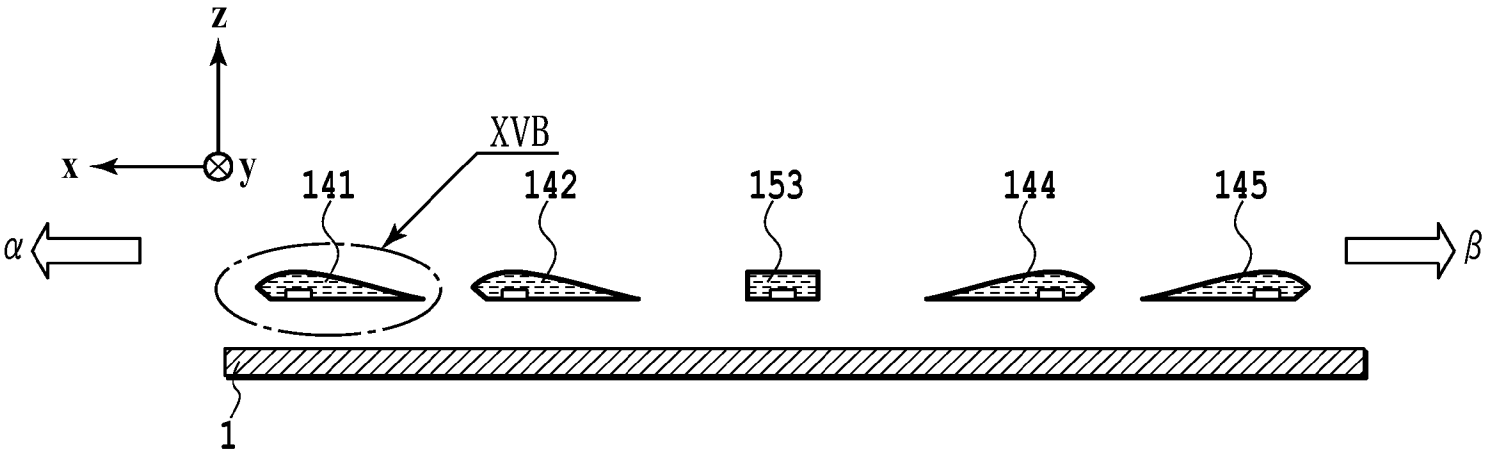
FIG. 15A is a diagram showing a modification in the fifth embodiment.
Figure 15B:
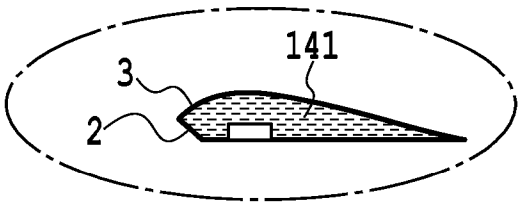
FIG. 15B is an enlarged diagram showing a part of the print head of FIG. 15A.

FIG. 15A is a diagram showing a modification in the present embodiment. First, since ink ejection is not made in the print heads after the third print head 143 at scanning, a curling-up air flow itself to be generated due to ejection is not generated. Therefore, regardless of strength/weakness of the air flow flowing into a region between the print head after the third print head 143 and the print medium 1, attachment of the floating mists on the head face in the print head after the third print head 143 is difficult to be generated. The event that the attachment of the floating mists on the head face in the print head after the third print head 143 is difficult to be generated means that an amount of the air flow flowing into a region between the subsequent print head after the third print head 143 and the print medium 1 may be any amount.

Therefore, the third print head 143 itself may not be necessarily formed in a wing shape, and as shown in FIG. 15A, when the third print head 143 has a configuration symmetrical in the scan direction, an amount of the air flow flowing into the region between the third print head 143 and the print medium 1 in the forward path and in the backward path can be constant. However, in a case of intentionally changing the amount of the air flow between at forward path direction printing and at backward path direction printing, the amount of the air flow may be adjusted by a size or an angle of the chamfered portion 2 or the plate controlling a direction of the air flow as shown in the third embodiment without providing the symmetrical configuration.

These matters mean that the print head construction number, the number of the print heads used in a print in the forward path only and the number of the print heads used in a print in the backward path only may differ. The present embodiment may be replaced by the following construction. First, for example, the present embodiment is designed such that the print head construction number is a pieces, wherein the number of the print heads used for the print in the forward path only is p pieces, the number of the print heads used for the print in the backward path only is q pieces, and a value of (n−p−q) is an odd number.

In this construction, the forward path direction is defined as a reference direction, and the $n_{00}$ print head positioned in the head in the reference direction to the $n_{02}$ print head each equipped with the wing front edge portion 3 in a portion with which the air flow collides at printing are defined to be used for a print in the forward path direction. The $n_{h2}$ print head to the n print head each equipped with the wing front edge portion 3 in a direction where the air flow at the backward path direction print collides are defined to be used for a print in the backward path. In addition, $n_n$ pieces of the print heads existing between the print head used in the forward path direction and the print head used in the backward path direction are defined to be used in prints in the interactive directions of the forward path and the backward path. Herein, each print head can be expressed as follows.

$$n_{02}=(n-p-q-1)/2+p$$

$$n_{h2}=(n-p-q+1)2+p+1.$$

In addition, $n_n$ can be expressed as follows.

$$n_n=(n-p-q+1)/2$$

With this print head construction, the restriction effect of the separation vortex as the concept of the present invention can be obtained in each print head.

Figure 16A:
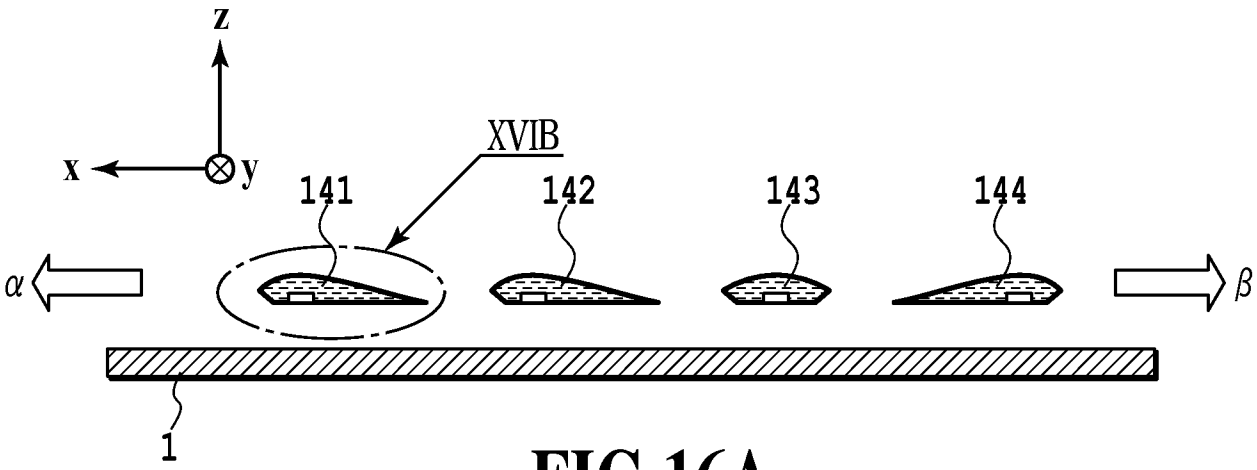
FIG. 16A is a diagram showing the other modification in the fifth embodiment.
Figure 16B:
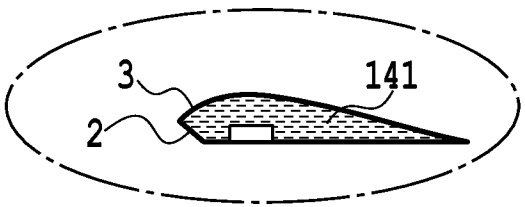
FIG. 16B is an enlarged diagram showing a part of the print head of FIG. 16A.
Figure 17A:
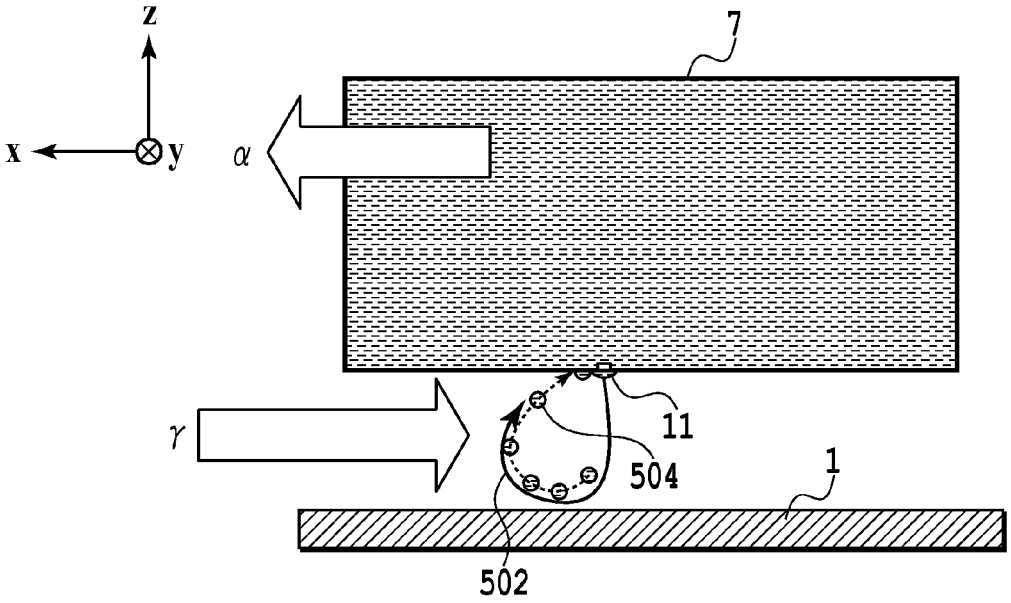
FIG. 17A is a diagram schematically showing a conventional print head.
Figure 17B:
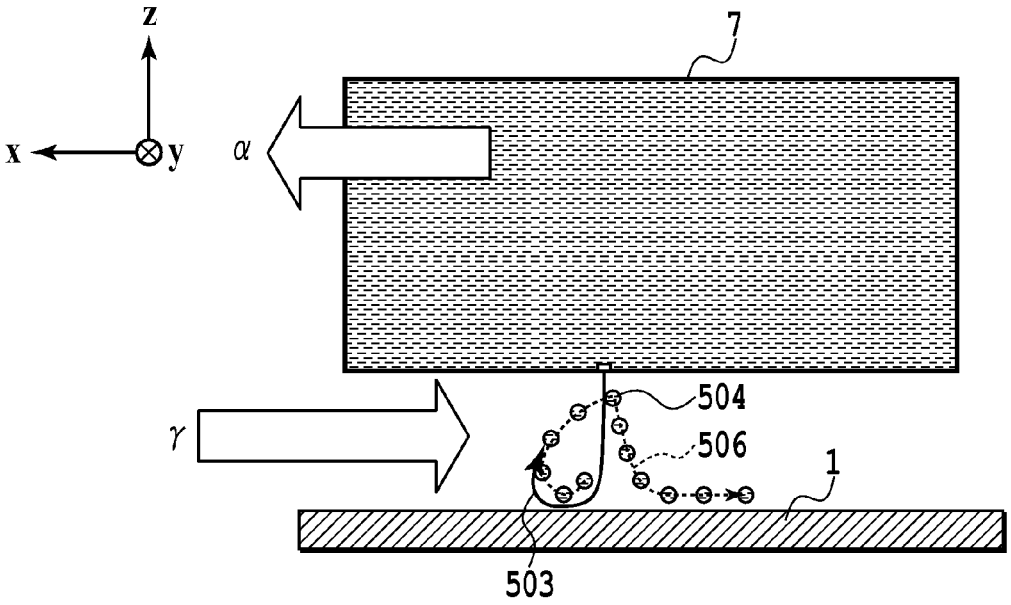
FIG. 17B is a diagram schematically showing the conventional print head.

FIG. 16A is a diagram showing a print head construction of a different modification in the present embodiment, which is a case where the number of the print heads is four pieces, wherein the number of the print heads used for the print in the forward path direction (arrow α direction) only is two pieces, the number of the print head used for the print in the backward path direction (arrow β direction) only is one piece, and the number of the print head used for the prints in the interactive directions of the forward path and the backward path is one piece.

Even in this case, the first print head 141 and the second print head 142 are used for the forward path print, the fourth print head 144 is used for the forward path, and the third print head 143 is used for the prints in the forward and backward paths. In consequence, an amount of the air flow flowing into a region between the print head for performing a print after the head print head in each scan direction and the print medium 1 can be increased to reduce an attachment amount of the floating mists on the head face.

By thus providing the wing-shaped print heads designed for both the directions of the forward direction and the backward direction, the air flow flowing into a region between a print head in the backward side of the print head and the medium is increased. With this construction, there can be realized the inkjet print apparatus which can prevent the floating mist from being attached on the head face to realize a print with high quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-088655, filed Apr. 7, 2010, which is hereby incorporated by reference herein in its entirety.

What is claimed is:

1. An inkjet print apparatus in which a plurality of print heads eject ink on a print medium from an ejection opening provided in the print head while moving in an arrangement direction of the print heads relatively to the print medium to perform a print thereon, wherein the plurality of the print heads comprise:

a first print head positioned forward in the moving direction of the print head; and a second print head adjacent to the first print head and positioned backward in the moving direction thereof, wherein the first print head is provided with an air flow guide face for guiding an air flow colliding with a front edge portion of the first print head in the moving direction into a region between the second print head and the print medium at the moving of the print head.

2. An inkjet print apparatus according to claim 1, wherein the air flow guide face restricts generation of a separation vortex between the first print head and the second print head.

3. An inkjet print apparatus according to claim 1, wherein the print head includes a front edge portion in the moving direction provided with an air flow introduction guide face for introducing the air flow colliding with the front edge portion into the region between the print head and the print medium at the moving of the print head.

* * * * *